US009694602B2

(12) United States Patent
Kobayashi

(10) Patent No.: US 9,694,602 B2
(45) Date of Patent: Jul. 4, 2017

(54) ELONGATED HOUSING, SUPPORT INSTRUMENT OF ELONGATED HOUSING, AND LIGHT IRRADIATION DEVICE

(71) Applicant: HOYA CANDEO OPTRONICS CORPORATION, Toda-shi, Saitama (JP)

(72) Inventor: Norio Kobayashi, Toda (JP)

(73) Assignee: HOYA CANDEO OPTRONICS CORPORATION, Toda-Shi, Saitama (JP)

( * ) Notice: Subject to any disclaimer, the term of this patent is extended or adjusted under 35 U.S.C. 154(b) by 0 days.

(21) Appl. No.: 15/083,963

(22) Filed: Mar. 29, 2016

(65) Prior Publication Data

US 2016/0288532 A1 Oct. 6, 2016

(30) Foreign Application Priority Data

Mar. 31, 2015 (JP) ..... 2015-073660

(51) Int. Cl.
*B41J 11/00* (2006.01)
*B41F 23/04* (2006.01)
*B41J 25/34* (2006.01)

(52) U.S. Cl.
CPC ..... *B41J 11/002* (2013.01); *B41F 23/0453* (2013.01); *B41J 25/34* (2013.01)

(58) Field of Classification Search
CPC ..... B41J 11/002; B41J 25/34; B41F 23/0453
See application file for complete search history.

(56) References Cited

U.S. PATENT DOCUMENTS

2007/0080616 A1* 4/2007 Lam ..... A47B 88/49 312/334.6
2012/0133716 A1* 5/2012 Aizawa ..... B41F 23/0453 347/102

FOREIGN PATENT DOCUMENTS

| | | | |
|---|---|---|---|
| JP | 59-36731 | U1 | 3/1984 |
| JP | 61-182662 | A | 8/1986 |
| JP | 3-143637 | A | 6/1991 |
| JP | 11-78614 | A | 3/1999 |
| JP | 2002-180736 | A | 6/2002 |
| JP | 2006-159668 | A | 6/2006 |
| JP | 2008-275300 | A | 11/2008 |
| JP | 2012-051335 | A | 3/2012 |
| WO | WO 2010-150780 | A1 | 12/2010 |

* cited by examiner

*Primary Examiner* — Manish S Shah
*Assistant Examiner* — Yaovi M Ameh
(74) *Attorney, Agent, or Firm* — Rabin & Berdo, P.C.

(57) ABSTRACT

Provided is an elongated housing which allows easy maintenance without being separated from the device body. The elongated housing, which is accommodated in a device body so that a lengthwise direction thereof becomes a first direction, includes a plurality of first rollers and a plurality of second rollers disposed on a first surface of the elongated housing to be arranged in a row along the first direction; and a plurality of third rollers and a plurality of fourth rollers disposed on a second surface of the elongated housing to be arranged in a row along the first direction, wherein the elongated housing is movably supported between a first state of being accommodated in the device body and a second state of being drawn from the device body in the first direction.

9 Claims, 9 Drawing Sheets

ELONGATED HOUSING, SUPPORT INSTRUMENT OF ELONGATED HOUSING, AND LIGHT IRRADIATION DEVICE

TECHNICAL FIELD

The present disclosure relates to an elongated housing (for example, a light irradiation device for irradiating a line-shaped light, an ink-jet head, or the like) included and used in a device body, a support instrument thereof, and a light irradiation device.

BACKGROUND ART

In the prior art, an ultraviolet (UV) curable ink which is cured by irradiation of ultraviolet rays is used as an ink for an offset sheet-fed printing or an ink-jet printer. To cure the ultraviolet curable ink, an ultraviolet ray irradiation device for irradiating ultraviolet rays is generally used, and regarding the use of printing particularly, since light should be irradiated to an irradiation region elongated in a direction (namely, a width direction of a paper) perpendicular to a transporting direction of a printing paper, a ultraviolet ray irradiation device elongated in a width direction of a paper for irradiating a line-shaped light is used.

As an ultraviolet ray irradiation device, a lamp-type irradiation device using a high-pressure mercury lamp or a mercury xenon lamp as a light source is known, and recently, according to the demands on reduced power consumption, longer life cycle and compact device size, an ultraviolet ray irradiation device using a light emitting diode (LED) as a light source, instead of an existing discharge lamp, has been developed. This ultraviolet ray irradiation device is disclosed in, for example, Patent Literature 1.

The ultraviolet irradiation device (ultraviolet irradiation unit) disclosed in Patent Literature 1 includes a plurality of ultraviolet light emitting semiconductor elements in plural rows, and is installed in a printing device with a posture in which a lengthwise direction of the ultraviolet irradiation unit is in a direction (namely, a width direction) perpendicular to a transporting direction of a printing medium. Since the printing device is configured to print with four-color UV inks of black (K), cyan (C), magenta (M) and yellow (Y), the printing device includes four printing units respectively corresponding to the colors, and four ultraviolet irradiation devices for curing inks, respectively, and these components are disposed along an outer circumference of a drum which transports a printing medium.

RELATED LITERATURES

Patent Literature

[Patent Literature 1] Japanese unexamined patent publication No. 2012-051335

DISCLOSURE

Technical Problem

In each ultraviolet ray irradiation device disclosed in Patent Literature 1, since it is preferred to irradiate ultraviolet rays which are approximately perpendicular to a printing medium and have high irradiation intensity, the ultraviolet ray irradiation device is positioned and fixed to be inclined in a printing device so that an emission surface is close to a printing medium. However, in the ultraviolet ray irradiation device used in such a printing device, since the scattered ink or the gas generated in curing an ink may contaminate the emission surface and deteriorate irradiation intensity, periodic maintenance is required, and thus in case of the constitution disclosed in Patent Literature 1, there is no sufficient work space between the emission surface and the printing medium, and maintenance may not be performed if each ultraviolet ray irradiation device is not separated from the printing device. In addition, once each ultraviolet ray irradiation device is separated from the printing device, a complicated positioning work is required for mounting the ultraviolet ray irradiation device again, and if maintenance is performed for all ultraviolet ray irradiation devices, long time is required and downtime of the printing device increases.

The present disclosure is designed in consideration of the above, and the present disclosure is directed to an elongated housing included and used in a device body, like a light irradiation device, and provides an elongated housing allowing easy maintenance without being separated from the device body, a support instrument of the elongated housing comprising it, and a light irradiation device allowing easy maintenance without being separated from the device body.

Technical Solution

In one general aspect, in order to achieve the purpose described above, the present disclosure provides an elongated housing, which is accommodated in a device body so that a lengthwise direction thereof becomes a first direction, the elongated housing comprising: a plurality of first rollers and a plurality of second rollers disposed on a first surface of the elongated housing to be arranged in a row along the first direction; and a plurality of third rollers and a plurality of fourth rollers disposed on a second surface of the elongated housing to be arranged in a row along the first direction, wherein each of the first rollers and each of the third rollers has a rotary shaft extending in a second direction perpendicular to the first direction and rotates on the rotary shaft, wherein each of the second rollers and each of the fourth rollers has a rotary shaft extending in a third direction perpendicular to the first direction and the second direction and rotates on the rotary shaft, wherein the first surface and the second surface are parallel to the second direction or the third direction, and wherein the elongated housing is movably supported between a first state of being accommodated in the device body and a second state of being drawn from the device body in the first direction.

In this configuration, since the elongated housing may be easily drawn from the device body, maintenance may be easily performed.

In addition, when being observed in the first direction, the rotary shaft of each of the first rollers and the rotary shaft of each of the third rollers may be disposed on the same line.

In addition, when being observed in the first direction, the rotary shaft of each of the first rollers and the rotary shaft of each of the third rollers may be disposed on different lines.

In addition, a roller surface of each of the second rollers may protrude further in the second direction in comparison to a roller surface of each of the first rollers, and a roller surface of each of the fourth rollers may protrude further in the second direction in comparison to a roller surface of each of the third rollers.

In addition, the number of the plurality of first rollers and the number of the plurality of third rollers may be identical, the number of the plurality of second rollers and the number of the plurality of fourth rollers may be identical, the plurality of first rollers and the plurality of third rollers may be disposed symmetrically with the elongated housing being interposed therebetween, and the plurality of second rollers and the plurality of fourth rollers may be disposed symmetrically with the elongated housing being interposed therebetween.

In addition, in another aspect, the present disclosure provides a support instrument of an elongated housing, which includes the elongated housing described above, the support instrument comprising: a first guide rail disposed in the device body to accommodate and support the plurality of first rollers and the plurality of second rollers; and a second guide rail disposed in the device body to accommodate and support the plurality of third rollers and the plurality of fourth rollers.

In addition, in the support instrument of an elongated housing, at least one of the plurality of first rollers and the plurality of second rollers may come into contact with an inner surface of the first guide rail, and at least one of the plurality of third rollers and the plurality of fourth rollers may come into contact with an inner surface of the second guide rail.

In addition, in another aspect, the present disclosure provides a light irradiation device, which is accommodated in a device body and extends in a first direction on a predetermined irradiation surface in the device body to irradiate a line-shaped light having a predetermined line width in a second direction perpendicular to the first direction, the light irradiation device comprising: a substrate; a plurality of light sources arranged on the substrate at predetermined intervals along the first direction to match an optic axis thereof in a third direction perpendicular to the first direction and the second direction; a box-type case configured to accommodate the substrate and the plurality of light sources; a plurality of first rollers and a plurality of second rollers arranged on a first surface of the case in a row along the first direction; and a plurality of third rollers and a plurality of fourth rollers arranged on a second surface of the case in a row along the first direction, wherein each of the first rollers and each of the third rollers has a rotary shaft extending in the second direction and rotates on the rotary shaft, wherein each of the second rollers and each of the fourth rollers has a rotary shaft extending in the third direction and rotates on the rotary shaft, wherein the first surface and the second surface are parallel to the second direction or the third direction, and wherein the case is movably supported between a first state of being accommodated in the device body and a second state of being drawn from the device body in first direction.

In addition, in the light irradiation device, the device body may include a first guide rail configured to accommodate and support the plurality of first rollers and the plurality of second rollers; and a second guide rail configured to accommodate and support the plurality of third rollers and the plurality of fourth rollers.

In addition, in the light irradiation device, the plurality of light sources may be arranged to have M (M is an integer of 2 or above) light sources along the first direction and to be in N rows (N is an integer of 2 or above) along the second direction.

In addition, in the light irradiation device, the light may have a wavelength giving an effect to an ultraviolet curable ink.

Advantageous Effects

As described above, according to the present disclosure, an elongated housing allowing easy maintenance without being separated from a device body, a support instrument of the elongated housing comprising it, and a light irradiation device allowing easy maintenance without being separated from a device body are implemented.

BEST MODE

Figure 1:
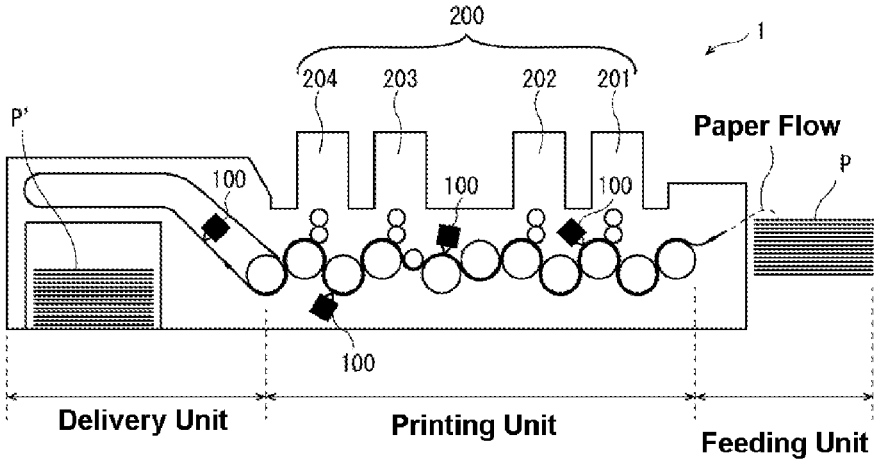
FIG. 1 is a diagram showing an example of a case where an elongated housing according to an embodiment of the present disclosure and a support instrument thereof are applied to a light irradiation device and an offset sheet-fed printing device including the same.

Hereinafter, the embodiments of the present disclosure will be described in detail with reference to accompanying drawings. Meanwhile, in the drawings, identical or corresponding portions will be endowed with the same reference numeral and not described repeatedly.

Figure 2:
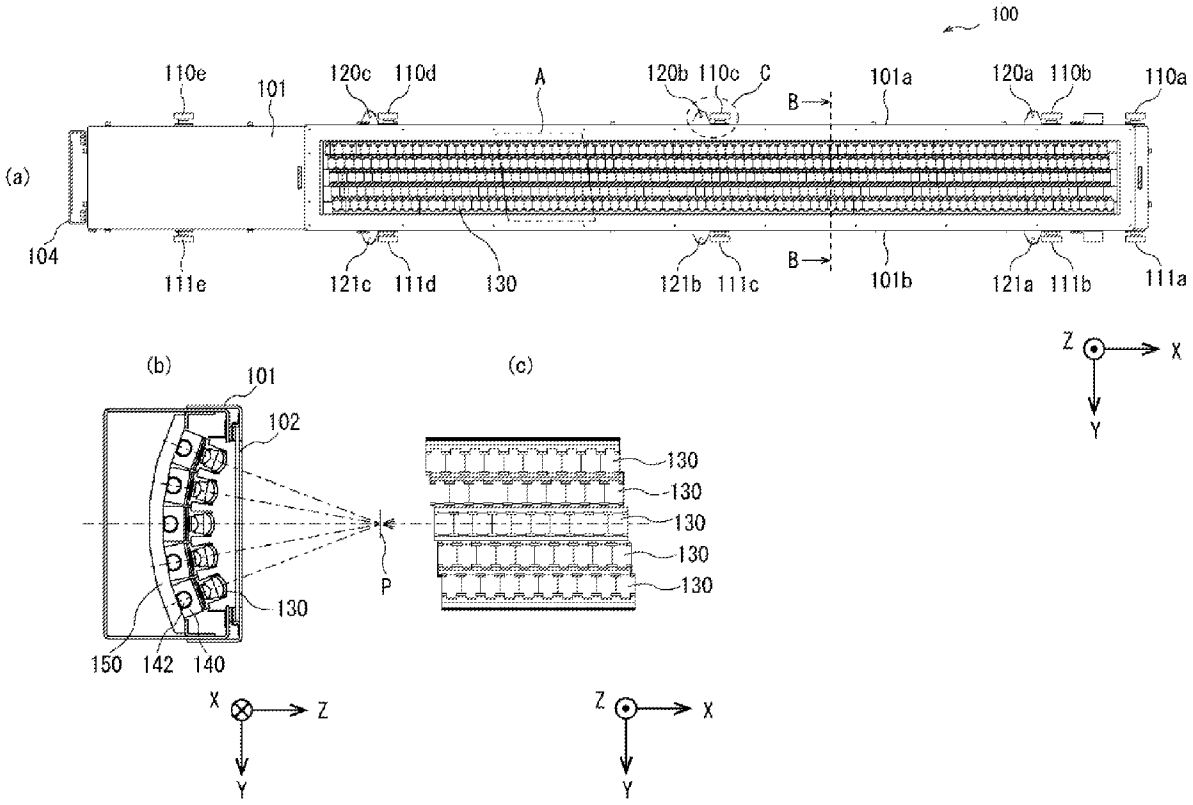
FIG. 2 is a diagram for illustrating a configuration of a light irradiation device according to an embodiment of the present disclosure.

FIG. 1 is a diagram showing an example of a case where an elongated housing according to an embodiment of the present disclosure and a support instrument thereof is applied to a light irradiation device 100 and an offset sheet-fed printing device 1 including the same. In addition, FIG. 2 is a diagram for illustrating a configuration of a light irradiation device 100 according to an embodiment of the present disclosure, where FIG. 2(*a*) is a plane view showing the light irradiation device 100, observed in a Z-axis direction, FIG. 2(*b*) is a cross-sectional view taken along the line B-B of FIG. 2(*a*), and FIG. 2(*c*) is an enlarged view showing a portion A of FIG. 2(*a*). As shown in FIG. 1, the light irradiation device 100 of this embodiment is an elongated housing included in plural in the offset sheet-fed printing device 1 to cure an ultraviolet curable ink of each color, and a light source device for outputting line shaped ultraviolet rays to a printing medium P. Meanwhile, in this specification, as shown in the coordinate of FIG. 2(*a*), an arrangement direction of a LED element 133 described later (namely, a lengthwise direction of the light irradiation device 100) is defined as an X-axis direction, a direction in which the LED element 133 emits ultraviolet rays is defined as a Z-axis direction, and a direction perpendicular to the Y-axis direction and the Z-axis direction (namely, a short direction of the light irradiation device 100) is defined as a Y-axis direction.

As shown in FIG. 1, the offset sheet-fed printing device 1 includes a feeding unit for feeding a sheet-shaped printing medium P into the offset sheet-fed printing device 1, a printing unit for printing a printing medium P while carrying the printing medium P, and a delivery unit for accommodating a printing medium P' printed by the printing unit in order. The printing unit includes printing units 201, 202, 203, 204 for transferring four-color ultraviolet curable inks of black, cyan, magenta and yellow onto the printing medium P, respectively, and four light irradiation devices 100 for curing an ultraviolet curable ink of each color, transferred onto the printing medium P by each of the printing units 201, 202, 203, 204.

As shown in FIG. 2, the light irradiation device 100 of this embodiment includes 45 LED units 130 arranged to have nine LED units along the X-axis direction to be in five rows along the Y-axis direction, a box-type case 101 accommodating the LED units 130, and the like. In addition, an ultraviolet ray emitted from each LED unit 130 is configured to output through a cover glass 102 installed at one surface of the case 101. Meanwhile, in FIG. 2(*b*), a dashed dotted line represents an optic axis of each LED unit 130, and the optic axis of each LED units 130 of this embodiment are configured so that the optic axes are intersected on the printing medium P (details will be described later).

Figure 3:
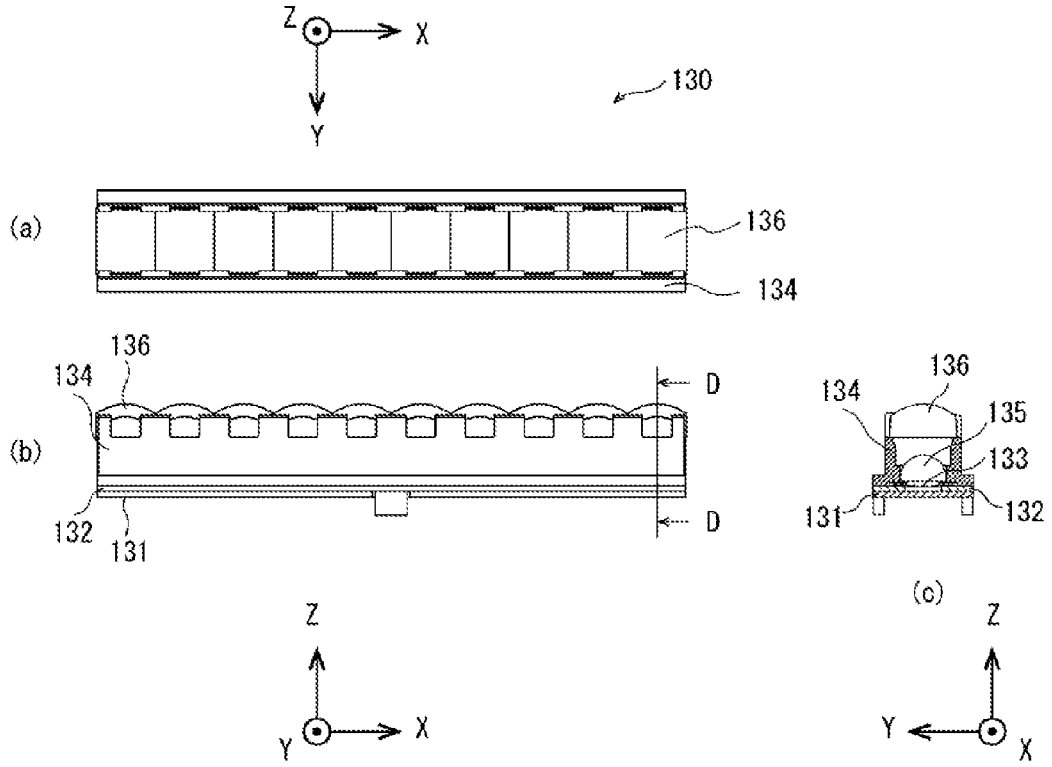
FIG. 3 is a diagram for illustrating a configuration of each LED unit of the light irradiation device according to an embodiment of the present disclosure.

FIG. 3 is a diagram for illustrating a configuration of each LED unit 130. FIG. 3(*a*) is a diagram showing the LED unit 130, observed in the Z-axis direction, FIG. 3(*b*) is a diagram showing the LED unit 130, observed in the Y-axis direction, and FIG. 3(*c*) is a cross-sectional view, taken along the line D-D of FIG. 3(*b*). As shown in FIG. 3, the LED unit 130 of this embodiment includes a metallic plate-shaped base plate 131 extending in the X-axis direction, a substrate 132 extending in the X-axis direction, ten LED elements 133 disposed on the substrate, a first lens 135 and a second lens 136 disposed in an optical path of each LED element 133, and a lens frame 134 having a "U"-shaped section (a section in the Y-axis direction) which extends in the X-axis direction, accommodates the first lens 135 and supports the second lens 136.

Ten LED elements 133 are disposed on the substrate 132 of this embodiment in a row in the X-axis direction at predetermined intervals, in a state of matching their optic axes in the Z-axis direction, and are electrically connected to the substrate 132. The substrate 132 is connected to an LED driving circuit, not depicted, and a driving current is supplied to each LED element 133 through the substrate 132 from the LED driving circuit. If a driving current is supplied to each LED element 133, ultraviolet rays of an intensity according to the driving current are output from each LED element 133, and line-shaped ultraviolet rays parallel to the X-axis direction are output from the LED unit 130. Meanwhile, in each LED element (133) of this embodiment, a driving current supplied to each LED element 133 of this embodiment is adjusted so that the LED elements 133 emit approximately the same intensity of ultraviolet ray, and the line-shaped ultraviolet rays emitted from the LED unit 130 have approximately uniform intensity distribution in the X-axis direction. Meanwhile, each LED element 133 of this embodiment includes an approximately square light emitting surface (not shown), and is supplied with a driving current from the LED driving circuit to emit ultraviolet rays having a wavelength of 365 nm.

The first lens 135 and the second lens 136 allows the ultraviolet rays emitted from the LED element 133 to extend in the X-axis direction so as to form a single line-shaped ultraviolet ray having a predetermined line width in the Y-axis direction.

As shown in FIGS. 3(*a*) to (*c*), the first lens 135 of this embodiment is a circular flat-convex lens having a flat first surface (a surface toward the LED element 133) and a spherical second surface (a surface toward the second lens 136). Each of the first lenses 135 have the same shape and optical characteristics respectively, and are fixed to be accommodated at a bottom of the lens frame 134 having a "U"-shaped section, so as to be located on the optical path of a corresponding LED element 133.

The ultraviolet ray emitted from the LED element 133 is input to the first surface of the first lens 135 and is output from the second surface. If the ultraviolet ray emitted from the LED element 133 passes through the first lens 135 as described above, the ultraviolet ray is shaped to have a predetermined diffusion angle.

The second lens 136 is a toroidal lens having different refractive powers in the X-axis direction and the Y-axis direction respectively, and in this embodiment, a 10-consecutive mold toroidal lens in which ten second lenses 136 are connected in the X-axis direction. The second lens 136 is a plane rectangular flat-convex lens having a planar first surface (a surface toward the first lens 135) and a toroidal second surface (an emission surface). Each of the second lenses 136 have the same shape and optical characteristics and are fixed to and supported by a front end of the lens frame 134 having a "U"-shaped section so as to be located on the optical path of a corresponding LED element 133.

The ultraviolet ray emitted from the LED element 133 and passing through the first lens 135 is input to the first surface of the second lens 136, focused in the X-axis direction and the Y-axis direction, respectively, and output from the second surface. In addition, the ultraviolet ray emitted from each second lens 136 is overlapped with an ultraviolet ray emitted from an adjacent second lens 136 in the X-axis direction, and from the LED unit 130, a single line-shaped ultraviolet ray extending in the X-axis direction and having a predetermined line width in the Y-axis direction is output.

As shown in FIG. 2(*a*), in this embodiment, nine LED units 130 are closely disposed successively in the X-axis direction. Since ultraviolet rays emitted from the nine LED units 130 arranged along the X-axis direction are overlapped in the X-axis direction at a joint portion to an adjacent LED unit 130, as described above, from the nine LED units 130 arranged along the X-axis direction (namely, nine LED units 130 in each row), a single line-shaped ultraviolet ray extending in the X-axis direction and having a predetermined line width in the Y-axis direction is output.

As shown in FIG. 2(*b*), in this embodiment, nine LED units 130 are arranged in one row, and the LED units 130 are arranged in five rows along the Y-axis direction. For this reason, five line-shaped ultraviolet rays are emitted from the light irradiation device 100 of this embodiment, and five rows of the LED units 130 arranged in the Y-axis direction are disposed in an arc shape, so that the line-shaped ultraviolet rays emitted from the LED units 130 of each row are overlapped with each other on the printing medium P.

The case 101 includes a metallic support member 150 elongated along the X-axis direction and having a concave arc surface with an arc shape with respect to the Z-axis direction, and five metallic cooling pipes 140 respectively elongated along the X-axis direction and arranged on the arc surface of the support member 150 along the Y-axis direction, therein. In addition, as nine LED units 130 of each row are fixed on each cooling pipe 140, five rows of the LED units 130 are disposed in an arc shape, and the line-shaped ultraviolet rays emitted from the LED units 130 of each row are overlapped with each other on the printing medium P. If the line-shaped ultraviolet rays emitted from the LED units 130 of each row are overlapped with each other on the printing medium P, ultraviolet rays of uniform and high irradiation intensity may be irradiated to ultraviolet curable inks transferred onto the printing medium P. By doing so, the ultraviolet curable inks on the printing medium P may be regularly cured. Meanwhile, a channel 142 through which a cooling water flows is formed in each cooling pipe 140, so that a cooling water is supplied from a cooling water supply means (not shown) connected to each channel 142, thereby cooling nine LED units 130 of each row. In addition, as shown in FIG. 2(*c*), in this embodiment, the LED units 130 of each row arranged along the Y-axis direction are disposed to be shifted along the X-axis direction in order as much as ⅕ of an interval between LED elements 133 on the substrate 132. If the LED units 130 of each row are shifted along the X-axis direction, each of the LED elements 133 are uniformly disposed with respect to the X-axis direction, and thus irradiation intensity of ultraviolet rays overlapped on the printing medium P becomes approximately uniform in the X-axis direction. As described above, from the light irradiation device 100 of this embodiment, ultraviolet rays of uniform and high irradiation intensity are irradiated.

As described above, the light irradiation device 100 according to this embodiment is a device included in the offset sheet-fed printing device 1 to cure an ultraviolet curable ink on the printing medium P. Therefore, generally, in order to irradiate ultraviolet rays having as high irradiation intensity as possible to the printing medium P, each light irradiation devices 100 are disposed adjacent to the printing medium P. However, if each light irradiation device 100 is disposed adjacent to the printing medium P, scattered ultraviolet curable ink or gas generated in curing the ink may contaminate the cover glass 102 and deteriorate irradiation intensity, and thus periodic maintenance, such as mopping of the cover glass 102, is required. The maintenance may be easily performed if a sufficient work space is ensured around the cover glass 102, but in a situation where each light irradiation device 100 is disposed adjacent to the printing medium P, like the light irradiation device 100 according to this embodiment, it is difficult to ensure a sufficient work space around the cover glass 102. For this reason, in this embodiment, each light irradiation device 100 in the offset sheet-fed printing device 1 is configured so as to be drawn in the X-axis direction to solve the above problem.

Figure 4:
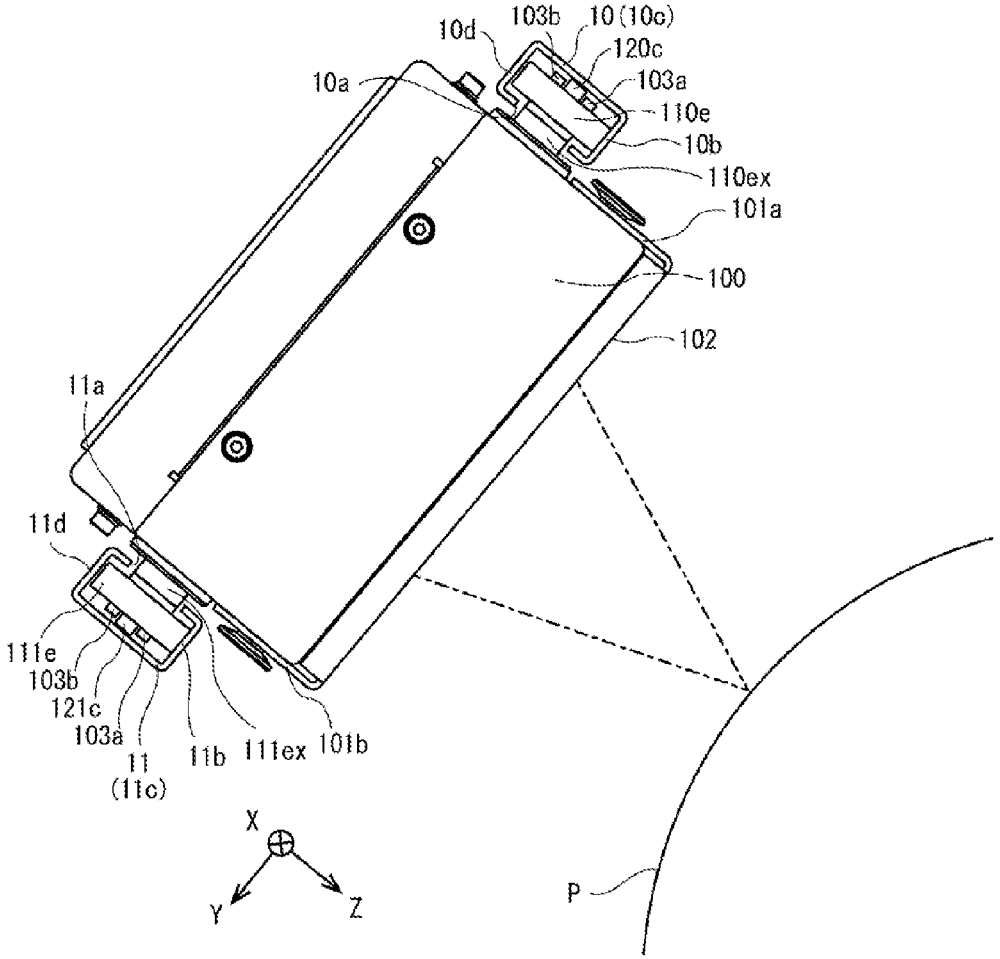
FIG. 4 is a diagram for illustrating a state where the light irradiation device according to this embodiment is mounted to an offset sheet-fed printing device.

FIG. 4 is a diagram for illustrating a state where the light irradiation device 100 according to this embodiment is mounted to the offset sheet-fed printing device 1, which shows a mounting state of a light irradiation device 100 located at a rightmost side in FIG. 1, observed in the X-axis direction. As shown in FIG. 2(*a*) and FIG. 4, the light irradiation device 100 of this embodiment includes five first rollers 110*a* to 110*e* and three second rollers 120*a* to 120*c* arranged in a row along the X-axis direction, on a side panel 101*a* of the case 101. The first rollers 110*a* to 110*e* respectively have rotary shafts 110*ax* to 110*ex* extending in the Y-axis direction (in FIG. 4, the rotary shafts 110*ax* to 110*dx* are not shown), and serve as rotating members rotating thereon. In addition, the second rollers 120*a* to 120*c* respectively have rotary shafts 120*ax* to 120*cx* (not shown in FIG. 4) extending in the Z-axis direction, and serve as rotating members rotating thereon. In addition, the first rollers 110*a* to 110*e* and the second rollers 120*a* to 120*c* are configured to be inserted (accommodated) in a guide rail 10 installed in the offset sheet-fed printing device 1.

In addition, as shown in FIG. 2(*a*) and FIG. 4, the light irradiation device 100 of this embodiment includes five third rollers 111*a* to 111*e* and three fourth rollers 121*a* to 121*c* arranged in a row along the X-axis direction, on a side panel 101*b* parallel to the side panel 101*a*. Each of the third rollers 111*a* to 111*e* respectively have rotary shafts 111*ax* to 111*ex* (in FIG. 4, the rotary shafts 111*ax* to 111*dx* are not shown) extending in the Y-axis direction, and serve as rotating members rotating thereon. In addition, each of the fourth rollers 121*a* to 121*c* respectively have rotary shafts 121*ax* to 121*cx* (not shown in FIG. 4) extending in the Z-axis direction, and serve as rotating members rotating thereon. In addition, the third rollers 111*a* to 111*e* and the fourth rollers 121*a* to 121*c* are configured to be inserted (accommodated) in a guide rail 11 installed in the offset sheet-fed printing device 1. Meanwhile, in this embodiment, the first rollers 110*a* to 110*e* and the third rollers 111*a* to 111*e* are disposed at symmetric locations with the case 101 being interposed therebetween, and the second rollers 120*a* to 120*c* and the fourth rollers 121*a* to 121*c* are disposed at symmetric locations with case 101 being interposed therebetween (FIG. 2(*a*)).

As shown in FIG. 4, in this embodiment, when being observed in the X-axis direction, the rotary shafts 110*ax* to 110*ex* of each of the first rollers 110*a* to 110*e* and the rotary shafts 111*ax* to 111*ex* of each of the third rollers 111*a* to 111*e* are disposed on the same line, and the guide rail 10 and the guide rail 11 are disposed at both ends of the light irradiation device 100 along the Y-axis direction. Meanwhile, as shown in FIG. 4, the guide rail 10 and the guide rail 11 of this embodiment have an approximately "[”-shaped section since they have two-directional loads of the Y-axis direction and the Z-axis direction. In addition, when supporting a heavy and long article such as the light irradiation device 100, the guide rail 10 and the guide rail 11 may be deformed, which may cause the first rollers 110*a* to 110*e*, the second rollers 120*a* to 120*c*, the third rollers 111*a* to 111*e* and the fourth rollers 121*a* to 121*c* to deviate from the guide rail 10 and the guide rail 11. For this reason, in the guide rail 10 and the guide rail 11 of this embodiment, front ends of side surfaces 10*b*, 10*d* of the guide rail 10 and side surfaces 11*b*, 11*d* of the and guide rail 11 are bent inwards to have an approximately "C”-shaped section. In addition, it is also possible that any one front end of the side surfaces 10*b*, 10*d* and any one end of the side surfaces 11*b*, 11*d* are bent inwards to have an approximately "J”-shaped section.

As described above, since the first rollers 110*a* to 110*e* and the second rollers 120*a* to 120*c* are accommodated in the guide rail 10 and the third rollers 111*a* to 111*e* and the fourth rollers 121*a* to 121*c* are accommodated in the guide rail 11, the light irradiation device 100 of this embodiment may be supported to be movable in the X-axis direction along the guide rails 10, 11. In addition, when the light irradiation device 100 is accommodated in the offset sheet-fed printing device 1 along the guide rails 10, 11 (namely, in a state of FIG. 4), the cover glass 102 of the light irradiation device 100 is positioned to face the printing medium P and allow the ultraviolet ray (depicted with a dashed dotted line in FIG.

4) emitted from the light irradiation device 100 to be focused on the printing medium P. In addition, when the light irradiation device 100 is drawn from the offset sheet-fed printing device 1 along the guide rails 10, 11, an emission surface (namely, the cover glass 102) of the light irradiation device 100 is entirely exposed outwards, so that maintenance may be performed to the light irradiation device 100. Hereinafter, the support instrument of the light irradiation device 100 configured by the first rollers 110*a* to 110*e*, the second rollers 120*a* to 120*c*, the third rollers 111*a* to 111*e*, the fourth rollers 121*a* to 121*c*, and the guide rails 10, 11 will be described in detail.

Figure 5:
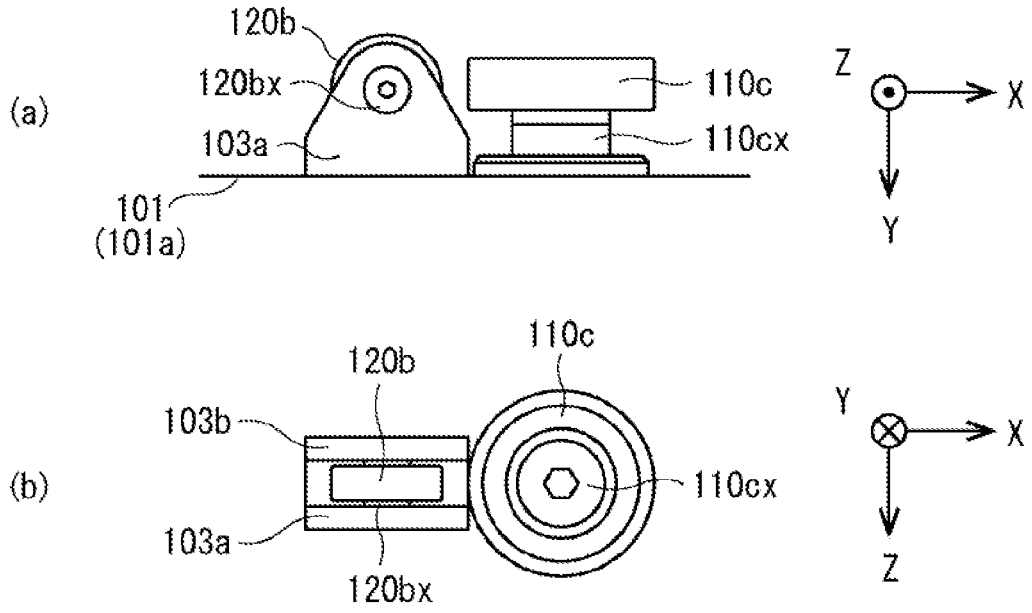
FIG. 5 is a diagram for illustrating configurations of a first roller and a second roller of the light irradiation device according to an embodiment of the present disclosure.
Figure 6:
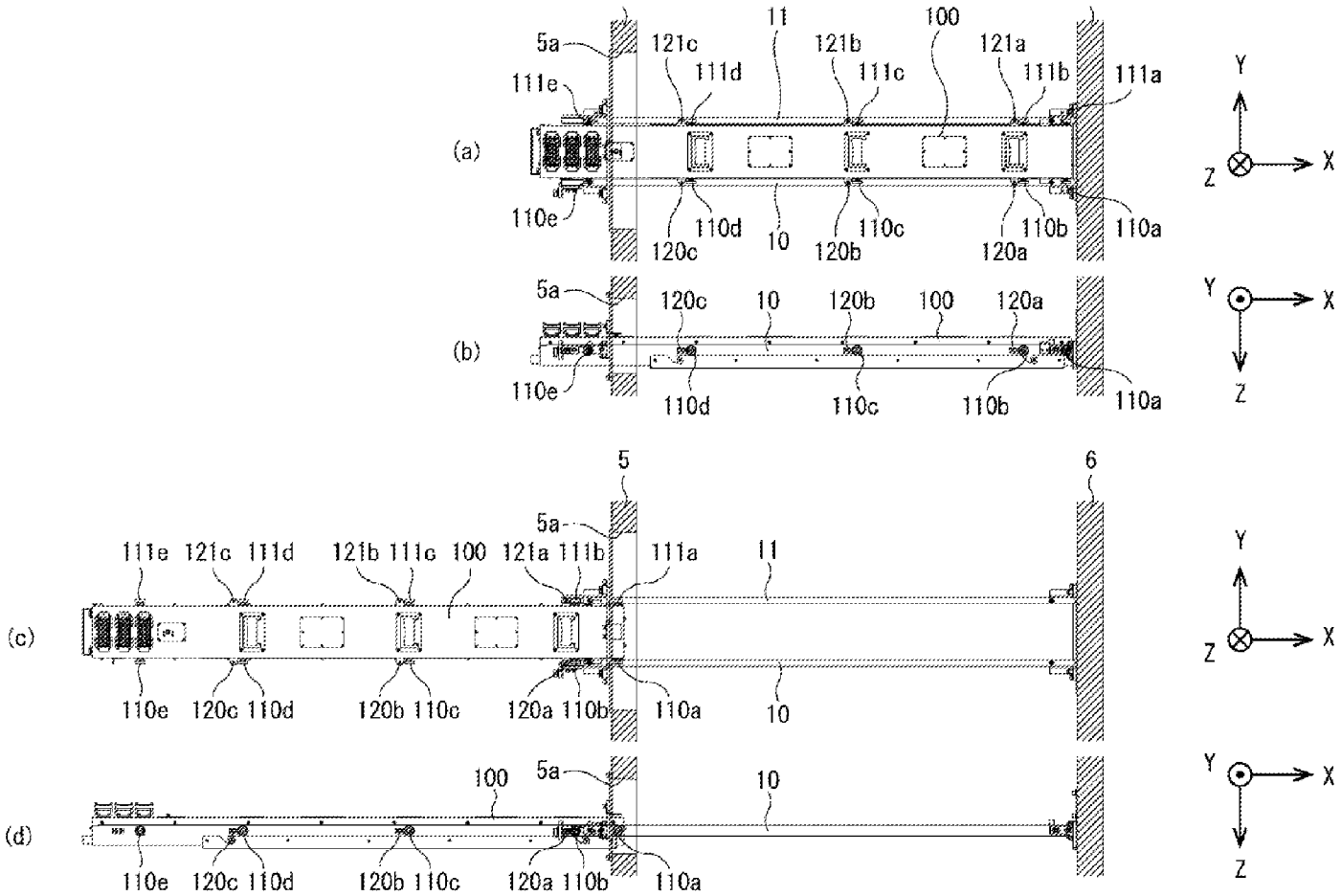
FIG. 6 is a diagram for illustrating a state where the light irradiation device according to an embodiment of the present disclosure is accommodated in an offset sheet-fed printing device and a state of being drawn in an X-axis direction.

FIG. 5 is a diagram for illustrating configurations of the first rollers 110*a* to 110*e*, the second rollers 120*a* to 120*c*, the third rollers 111*a* to 111*e* and the fourth rollers 121*a* to 121*c* of this embodiment. FIG. 5(*a*) is an enlarged view showing a portion C of FIG. 2, in which the first roller 110*c* and the second roller 120*b* are observed in the Y-axis direction. In addition, FIG. 5(*b*) is a diagram in which the first roller 110*c* and the second roller 120*b* of FIG. 5(*a*) are observed in the Z-axis direction. In addition, FIG. 6 is a diagram for illustrating a state (a first state) where the light irradiation device 100 is accommodated in the offset sheet-fed printing device 1 and a state (a second state) where the light irradiation device 100 is drawn in the X-axis direction. FIGS. 6(*a*) and (*b*) are diagrams showing a state where the light irradiation device 100 is accommodated in the offset sheet-fed printing device 1, where FIG. 6(*a*) is a diagram showing the light irradiation device 100 of FIG. 4, observed in the Z-axis direction (a site opposite to the case 101), and FIG. 6(*b*) is a diagram showing the light irradiation device 100 of FIG. 4, observed in the Y-axis direction (toward the side panel 101*a* of the case 101). FIGS. 6(*c*) and (*d*) are diagrams showing a state where the light irradiation device 100 is drawn from the offset sheet-fed printing device 1, where FIG. 6(*c*) is a diagram showing the light irradiation device 100 of FIG. 4, observed in the Z-axis direction (a site opposite to the case 101), and FIG. 6(*d*) is a diagram showing the light irradiation device 100 of FIG. 4, observed in the Y-axis direction (toward the side panel 101*a* of the case 101).

As shown in FIG. 5, the first roller 110*c* is a rotating member rotating on a rotary shaft 110*cx* extending in the Y-axis direction form the side panel 101*a* of the case 101. In addition, the second roller 120*b* is a rotating member protruding in the Y-axis direction from the side panel 101*a* of the case 101 and rotating on a rotary shaft 120*bx* supported by a pair of rotary shaft support members 103*a*, 103*b* arranged in parallel to the Z-axis direction. As shown in FIG. 5(*a*), the roller surface of the second roller 120*b* is configured to slightly protrude in the Y-axis direction in comparison to the roller surface of the first roller 110*c* and come into contact with an inner surface of a bottom surface 10*c* of the guide rail 10, described later. In addition, as shown in FIG. 5(*b*), the roller surface of the first roller 110*c* is configured to have a diameter sufficiently greater than an interval of the rotary shaft support members 103*a*, 103*b* and is capable of contacting an inner surface of any one of a pair of side surfaces 10*b*, 10*d* of the guide rail 10, described later. In addition, when the light irradiation device 100 moves in the X-axis direction, the first roller 110*c* or the second roller 120*b* rotates in contact with the inner surface of the guide rail 10, thereby supporting movement of the light irradiation device 100 (namely, facilitating the movement). Each of the first rollers 110*a* to 110*e* of the light irradiation device 100 has the same configuration even though their locations in the X-axis direction are different, and thus the first rollers other than the first roller 110*c* are not described in detail. In addition, since each of the third rollers 111*a* to 111*e* has the same configuration as the first rollers 110*a* to 110*e* even though their mounting surfaces are different from those of the first rollers 110*a* to 110*e*, the third rollers 111*a* to 111*e* are not described herein. In addition, similarly, since each of the second rollers 120*a* to 120*c* has the same configuration even though their locations in the X-axis direction are different, the second rollers other than the second roller 120*b* are not described herein. In addition, since each of the fourth rollers 121*a* to 121*c* has the same configuration as the second rollers 120*a* to 120*c* even through their mounting surfaces are different from those of the second rollers 120*a* to 120*c*, the fourth rollers 121*a* to 121*c* are not described herein.

As shown in FIGS. 4 and 6, in the offset sheet-fed printing device 1 to which the light irradiation device 100 of this embodiment is mounted, the guide rail 10 for supporting the first rollers 110*a* to 110*e* and the second rollers 120*a* to 120*c* and the guide rail 11 for supporting the third rollers 111*a* to 111*e* and the fourth rollers 121*a* to 121*c* are installed along the X-axis direction from a front panel 5 of the offset sheet-fed printing device 1 to a rear panel 6 thereof. The guide rail 10 and the guide rail 11 are members having substantially the same length as the emission surface of the light irradiation device 100 and are arranged in parallel to the X-axis direction (FIG. 6). In addition, an opening 5*a* is formed in the front panel 5 to put or take out the light irradiation device 100.

As shown in FIG. 4, the guide rail 10 is a rectangular case-shaped member having a C-shaped section on the Y-Z plane, composed of a pair of side surfaces 10*b*, 10*d* and a bottom surface 10*c*, and the rotary shaft support members 103*a*, 103*b* respectively supporting the rotary shafts 120*ax* to 120*cx* of the second rollers 120*a* to 120*c* as well as the rotary shafts 110*ax* to 110*ex* (in FIG. 4, the rotary shafts 110*ax* to 110*dx* are not shown) of the first rollers 110*a* to 110*e* pass through the opening 10*a*, and the first rollers 110*a* to 110*e* and the second rollers 120*a* to 120*c* are accommodated therein (namely, in the case). In addition, similarly, the guide rail 11 is a rectangular case-shaped member having a C-shaped section on the Y-Z plane, and the rotary shaft support members 103*a*, 103*b* respectively supporting the rotary shafts 121*ax* to 121*cx* of each of the fourth rollers 121*a* to 121*c* as well as the rotary shafts 111*ax* to 111*ex* (in FIG. 4, the rotary shafts 111*ax* to 111*dx* are not shown) of the third rollers 111*a* to 111*e* pass through the opening 11*a*, and the third rollers 111*a* to 111*e* and the fourth rollers 121*a* to 121*c* are accommodated therein (namely, in the case). In addition, when the light irradiation device 100 is accommodated in the offset sheet-fed printing device 1 along the guide rails 10, 11 (namely, in a state of FIG. 4, FIG. 6(*a*) and FIG. 6(*b*)), the roller surface of at least one of the first rollers 110*a* to 110*e* and the second rollers 120*a* to 120*c* comes into contact with the inner surface of the guide rail 10, the roller surface of at least one of the third rollers 111*a* to 111*e* and the fourth rollers 121*a* to 121*c* comes into contact with the inner surface of the guide rail 11, and in this state, the light irradiation device 100 is positioned. For example, the light irradiation device 100 of FIG. 4 is mounted with a posture of emitting ultraviolet rays slightly downwards in a right direction, but if the light irradiation device 100 is mounted with this posture, due to the weight of the light irradiation device 100, the third rollers 111*a* to 111*e* at a lower side (namely, on the side panel 101*b*) contact the inner surface of the side surface 11*b* of the guide rail 11 at a lower side, simultaneously the fourth rollers 121*a* to 121*c* contacts the inner surface of the bottom surface 11*c* of the guide rail 11 at a lower side, and the first rollers 110*a* to 110*e* at an upper side (namely, on the side panel 101*a*) contacts the inner surface of the side surface 10*b* of the guide rail 10 at an upper side, thereby positioning and mounting the light irradiation device 100.

As described above, the light irradiation device 100 of this embodiment is supported to be movable in the X-axis direction along the guide rails 10, 11, and by pulling a handle 104 (FIG. 2(*a*)) installed at an end of the case 101 in the X-axis direction, the light irradiation device 100 may be drawn from the offset sheet-fed printing device 1 through the opening 5*a* (FIGS. 6(*c*), (*d*)). As described above, in this embodiment, regardless of a mounting posture (namely, a mounting angle) of the light irradiation device 100, at least one of the first rollers 110*a* to 110*e* and the second rollers 120*a* to 120*c* comes into contact with the inner surface of the guide rail 10, and at least one of the third rollers 111*a* to 111*e* and the fourth rollers 121*a* to 121*c* comes into contact with the inner surface of the guide rail 11. By doing so, if the handle 104 of the case 101 is pulled in the X-axis direction, at least one of the first rollers 110*a* to 110*e* and the second rollers 120*a* to 120*c* contacting the inner surface of the guide rail 10 and at least one of the third rollers 111*a* to 111*e* and the fourth rollers 121*a* to 121*c* contacting the inner surface of the guide rail 11 rotate. By doing so, the light irradiation device 100 may be drawn easily with a small load.

As described above, the light irradiation device 100 of this embodiment includes the first rollers 110*a* to 110*e* and the second rollers 120*a* to 120*c* on the side panel 101*a* and includes the third rollers 111*a* to 111*e* and the fourth rollers 121*a* to 121*c* on the side panel 101*b*. In addition, at the offset sheet-fed printing device 1 in which the light irradiation device 100 is included, the guide rail 10 accommodating the first rollers 110*a* to 110*e* and the second rollers 120*a* to 120*c* and the guide rail 11 accommodating the third rollers 111*a* to 111*e* and the fourth rollers 121*a* to 121*c* are installed. In addition, in this configuration, regardless of a mounting posture (namely, a mounting angle) of the light irradiation device 100, at least one of the first rollers 110*a* to 110*e* and the second rollers 120*a* to 120*c* contacts the inner surface of the guide rail 10, and at least one of the third rollers 111*a* to 111*e* and the fourth rollers 121*a* to 121*c* contacts the inner surface of the guide rail 11. In addition, in this configuration, the light irradiation device 100 may be securely positioned in the offset sheet-fed printing device 1, and further the light irradiation device 100 may be easily put or taken out along the X-axis direction. Since the light irradiation device 100 of this embodiment may be drawn from the offset sheet-fed printing device 1 as described above, maintenance required for the light irradiation device 100, for example mopping of the cover glass 102, may be easily performed.

Even though the embodiment of the present disclosure has been described above as an example, the present disclosure is not limited to the embodiment but may be modified in various ways within the scope defined in the claims. For example, even though it has been described in this embodiment that the light irradiation device 100 is included in the offset sheet-fed printing device 1 as an example of an elongated housing included and used in a device body, the present disclosure is not limited to such use and device but may be applied to an ink-jet head or ionizer (charge removing device) included and used in a printer, a high-frequency high-voltage discharge electrode included and used in a corona treatment device (hydrophilicity enhancer), a spray nozzle included in a cleaning, cooling, humidifying, coating or anti-static device, an air blow nozzle (for example, a slit nozzle or an air knife) included in a dehydration device or a hot blaster heater, a drier or corona device used in a laminate device, or a heater or measurer (for example, a light-intensity meter, a thermometer or hydrometer, or a telemeter) included and used in various device bodies, a camera, a scanner, a toner box, a UV light source, electron beam irradiation device, or the like.

In addition, even though it has been described that a ultraviolet ray is emitted from the light irradiation device 100 of this embodiment, the present disclosure is not limited to the ultraviolet ray, but for example, the present disclosure may also be applied to an irradiation device of another purpose, for example a light irradiation device emitting a white light.

Figure 7:
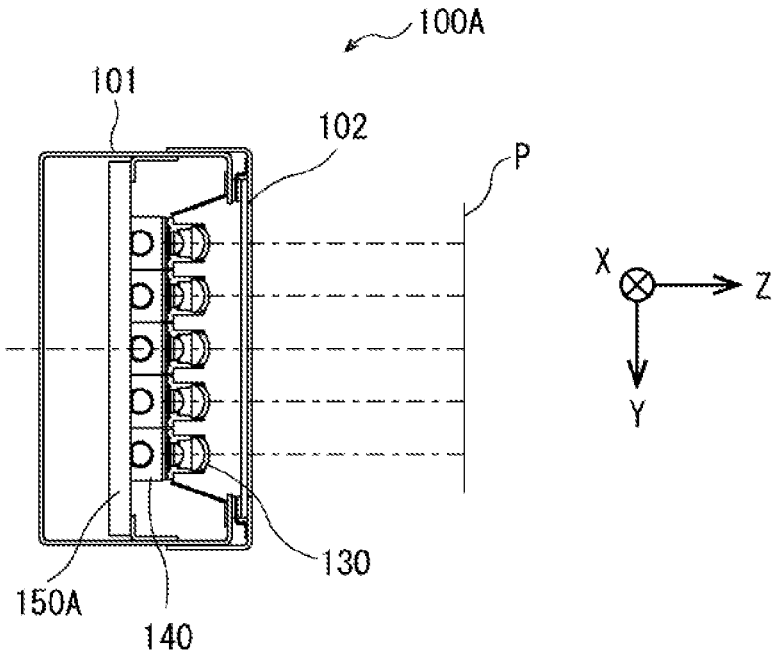
FIG. 7 is a diagram for illustrating a modification of the light irradiation device according to an embodiment of the present disclosure.
Figure 8:
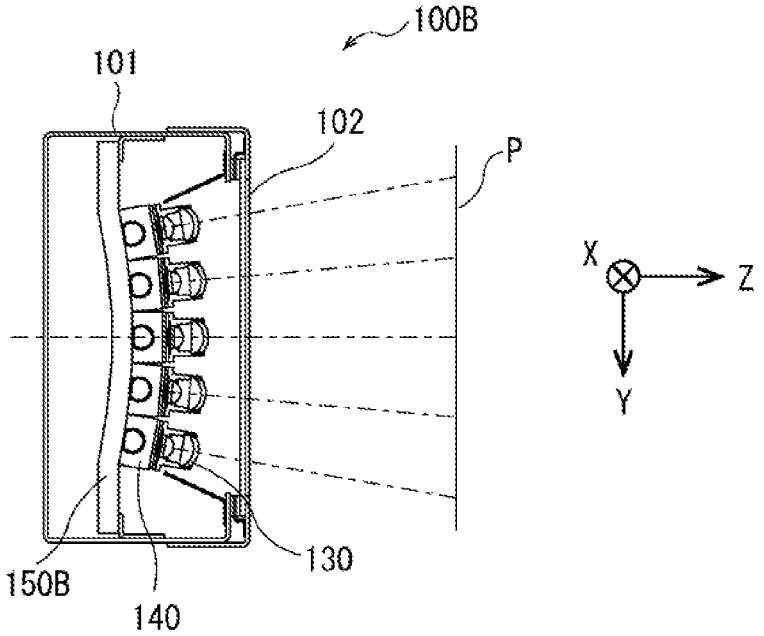
FIG. 8 is a diagram for illustrating a modification of the light irradiation device according to an embodiment of the present disclosure.

In addition, even though the light irradiation device 100 of this embodiment is configured so that five rows of LED units 130 arranged in the Y-axis direction are disposed in an arc shape and also line-shaped ultraviolet rays respectively emitted from the five rows of LED units 130 are overlapped with each other on the printing medium P, the present disclosure is not limited to this configuration. For example, as shown in FIG. 7, a surface of the support member 150A on which the cooling pipe 140 is disposed may be a flat surface, and optic axes of LED units 130 of each row may be arranged in parallel to the Z-axis direction. In this configuration, a broad ultraviolet ray approximately parallel to the Z axis is emitted from the light irradiation device 100A, and a predetermined area on the printing medium P is exposed. In addition, as shown in FIG. 8, a surface of the support member 150B on which the cooling pipe 140 is disposed may protrude with an arc shape, and optic axes of the LED units 130 of each row may be arranged to spread with respect to the Z-axis direction. In this configuration, a much broader ultraviolet ray is emitted from the light irradiation device 1008, in comparison to the light irradiation device 100A of FIG. 7, and thus a predetermined area on the printing medium P is exposed.

In addition, in this embodiment, even though the first rollers 110*a* to 110*e* and the third rollers 111*a* to 111*e* are disposed at symmetric locations with the case 101 being interposed therebetween and also the second rollers 120*a* to 120*c* and the fourth rollers 121*a* to 121*c* are disposed at symmetric locations with the case 101 being interposed therebetween, the present disclosure is not limited to this configuration. The first rollers 110*a* to 110*e* and the third rollers 111*a* to 111*e* may be disposed at asymmetric locations with the case 101 being interposed therebetween, and also the second rollers 120*a* to 120*c* and the fourth rollers 121*a* to 121*c* may also be disposed at asymmetric locations with the case 101 being interposed therebetween. In addition, the numbers of the first rollers 110*a* to 110*e* and the third rollers 111*a* to 111*e* are not limited to five, and these numbers need not be identical. The numbers of the first rollers 110*a* to 110*e* and the third rollers 111*a* to 111*e* may be suitably changed depending on the length of the light irradiation device 100. Also, similarly, the numbers of the second rollers 120*a* to 120*c* and the fourth rollers 121*a* to 121*c* are not limited to three, and these numbers need not be identical. The numbers of the second rollers 120*a* to 120*c* and the fourth rollers 121*a* to 121*c* may be suitably changed depending on the length of the light irradiation device 100.

Figure 9:
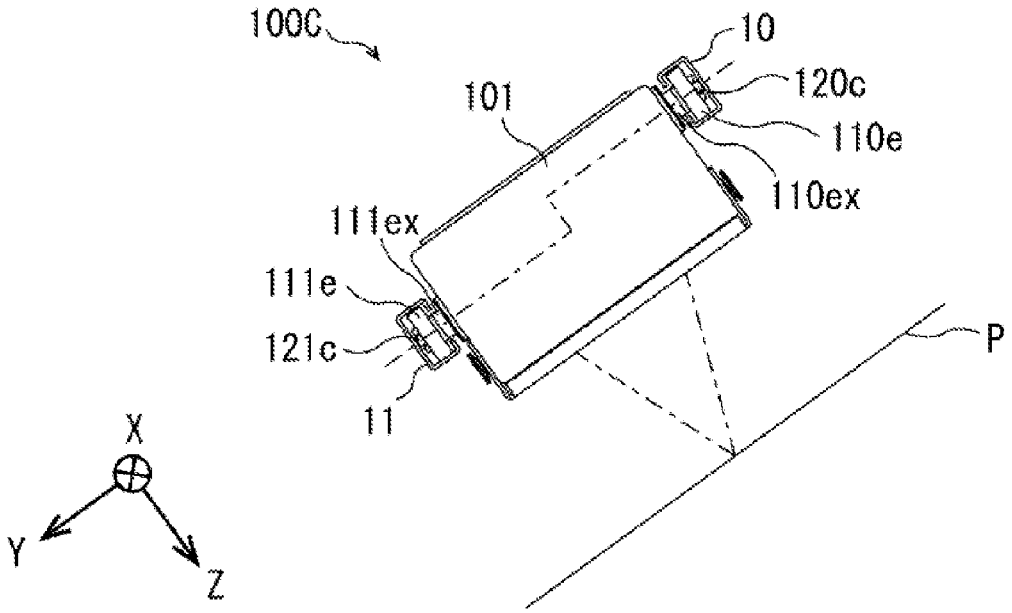
FIG. 9 is a diagram for illustrating a modification of the light irradiation device according to an embodiment of the present disclosure.

In addition, in this embodiment, even though when being observed in the X-axis direction, the rotary shafts 110*ax* to 110*ex* of each of the first rollers 110*a* to 110*e* and the rotary shafts 111*ax* to 111*ex* of each of the third rollers 111*a* to 111*e* are disposed on the same line and also the guide rail 10 and the guide rail 11 are disposed at both ends of the light irradiation device 100 along the Y-axis direction, the present disclosure is not limited to this configuration. For example, like a light irradiation device 100C according to a modification depicted in FIG. 9, the rotary shafts 110*ax* to 110*ex* of each of the first rollers 110*a* to 110*e* and the rotary shafts 111*ax* to 111*ex* of each of the third rollers 111*a* to 111*e* may be disposed on different lines parallel to the Y-axis direction. In this case, the guide rail 10 and the guide rail 11 are disposed at different locations with respect to the Z-axis direction, but the same effects as in this embodiment occur.

In addition, in this embodiment, even though the first rollers 110*a* to 110*e* and the second rollers 120*a* to 120*c* are disposed on the side panel 101*a* of the case 101 and also the third rollers 111*a* to 111*e* and the fourth rollers 121*a* to 121*c* are disposed on the side panel 101*b*, the present disclosure is not limited to this configuration. For example, like a light irradiation device 100D according to a modification depicted in FIG. 10, a roller fixing member 105 having a "U"-shaped section of the X-Y plane extending along the X-axis direction may be installed at the rear surface of the case 101, the first rollers 110*a* to 110*e* and the second rollers 120*a* to 120*c* are disposed on a wall 105*a* of the roller fixing member 105, and the third rollers 111*a* to 111*e* and the fourth rollers 121*a* to 121*c* may be disposed on a wall 105*b* of the roller fixing member 105.

Figure 10:
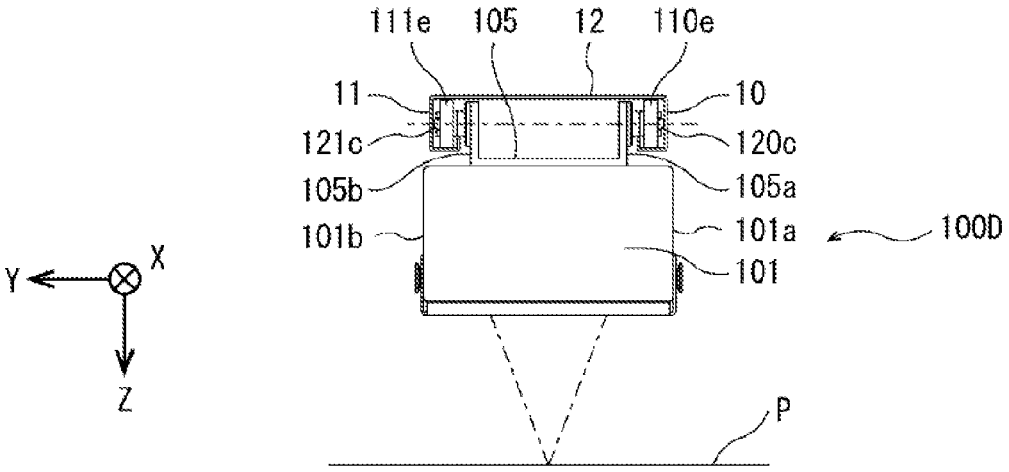
FIG. 10 is a diagram for illustrating a modification of the light irradiation device according to an embodiment of the present disclosure.

In addition, in this embodiment, even though the guide rail 10 and the guide rail 11 are configured as separate members, both ends of a flat metallic plate 12 may be bent as shown in FIG. 10 to integrally configure the guide rail 10 and the guide rail 11.

Figure 11:
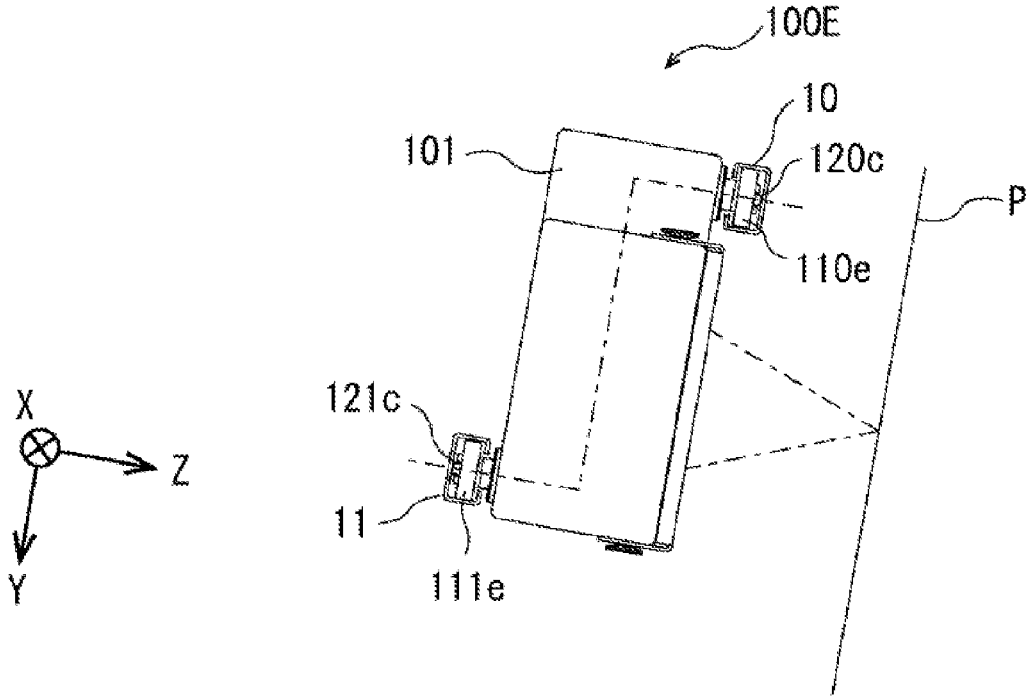
FIG. 11 is a diagram for illustrating a modification of the light irradiation device according to an embodiment of the present disclosure.

In addition, in this embodiment, even though the first rollers 110*a* to 110*e* and the second rollers 120*a* to 120*c* are disposed on the side panel 101*a* of the case 101, the third rollers 111*a* to 111*e* and the fourth rollers 121*a* to 121*c* are disposed on the side panel 101*b*, and the light irradiation device 100 is supported in the Y-axis direction by the guide rail 10 and the guide rail 11, the present disclosure is not limited to this configuration. For example, like a light irradiation device 100E according to a modification depicted in FIG. 11, the case 101 may extend in the Y-axis direction, the first rollers 110*a* to 110*e* and the second rollers 120*a* to 120*c* are disposed on the front surface of the case 101, the third rollers 111*a* to 111*e* and the fourth rollers 121*a* to 121*c* are disposed on the rear surface of the case 101, and the light irradiation device 100 may be supported in the Z-axis direction by the guide rail 10 and the guide rail 11.

Meanwhile, it should be understood that the embodiments disclosed herein are just examples and not intended to limit the present disclosure. The scope of the present disclosure is not defined by the above description but by the appended claims, and all equivalents and modifications of the claims are intended to falling within the scope of the present disclosure.

REFERENCE SYMBOLS

1: offset sheet-fed printing device
5: front panel
5*a*: opening
6: rear panel
10, 11: guide rail
10*a*: opening
10*b*: side surface
10*c*: bottom surface
12: plate
100: light irradiation device
101: case
101*a*, 101*b*: side panel
102: cover glass
103*a*, 103*b*: rotary shaft support member
104: handle
110*a*, 110*b*, 110*c*, 110*d*, 110*e*: first roller
110*ax*, 110*bx*, 110*cx*, 110*dx*, 110*ex*: rotary shaft
111*a*, 111*b*, 111*c*, 111*d*, 111*e*: third roller
111*ax*, 111*bx*, 111*cx*, 111*dx*, 111*ex*: rotary shaft
120*a*, 120*b*, 120*c*: second roller
120*ax*, 120*bx*, 120*cx*: rotary shaft
121*a*, 121*b*, 121*c*: fourth roller
121*ax*, 121*bx*, 121*cx*: rotary shaft
130: LED unit
131: base plate
132: substrate
133: LED element
134: lens frame
135: first lens
136: second lens
140: cooling pipe
142: channel
150: support member
201, 202, 203, 204: printing unit

The invention claimed is:

1. A light irradiation device, which is accommodated in a device body and extends in a first direction on a predetermined irradiation surface in the device body to irradiate a line-shaped light having a predetermined line width in a second direction perpendicular to the first direction, the light irradiation device comprising:

a substrate;

a plurality of light sources arranged on the substrate at predetermined intervals along the first direction to match an optic axis thereof in a third direction perpendicular to the first direction and the second direction;

a box-type case configured to accommodate the substrate and the plurality of light sources;

a plurality of first rollers and a plurality of second rollers arranged on a first surface of the case in a row along the first direction; and a plurality of third rollers and a plurality of fourth rollers arranged on a second surface of the case in a row along the first direction, wherein each of the first rollers and each of the third rollers has a rotary shaft extending in the second direction and rotates on the rotary shaft, wherein each of the second rollers and each of the fourth rollers has a rotary shaft extending in the third direction and rotates on the rotary shaft, wherein the first surface and the second surface are parallel to the second direction or the third direction, and wherein the case is movably supported between a first state of being accommodated in the device body and a second state of being drawn from the device body in first direction.

2. The light irradiation device according to claim 1, wherein when being observed in the first direction, the rotary shaft of each of the first rollers and the rotary shaft of each of the third rollers are disposed on the same line.

3. The light irradiation device according to claim 1, wherein when being observed in the first direction, the rotary shaft of each of the first rollers and the rotary shaft of each of the third rollers are disposed on different lines.

4. The light irradiation device according to according to claim 1, wherein a roller surface of each of the second rollers protrudes further in the second direction in comparison to a roller surface of each of the first rollers, and a roller surface of each of the fourth rollers protrudes further in the second direction in comparison to a roller surface of each of the third rollers.

5. The light irradiation device according to according to claim 1, wherein the number of the plurality of first rollers and the number of the plurality of third rollers are identical, the number of the plurality of second rollers and the number of the plurality of fourth rollers are identical, the plurality of first rollers and the plurality of third rollers are disposed symmetrically with the case being interposed therebetween, and the plurality of second rollers and the plurality of fourth rollers are disposed symmetrically with the case being interposed therebetween.

6. The light irradiation device according to according to claim 1, wherein the device body includes:

a first guide rail configured to accommodate and support the plurality of first rollers and the plurality of second rollers; and a second guide rail configured to accommodate and support the plurality of third rollers and the plurality of fourth rollers.

7. The light irradiation device according to claim 6, wherein at least one of the plurality of first rollers and the plurality of second rollers comes into contact with an inner surface of the first guide rail, wherein at least one of the plurality of third rollers and the plurality of fourth rollers comes into contact with an inner surface of the second guide rail.

8. The light irradiation device according to according to claim 1, wherein the plurality of light sources are arranged to have M (M is an integer of 2 or above) light sources along the first direction and to be in N rows (N is an integer of 2 or above) along the second direction.

9. The light irradiation device according to according to claim 1, wherein the light have a wavelength giving an effect to an ultraviolet curable ink.

* * * * *